US009861130B2

(12) United States Patent
Li et al.

(10) Patent No.: US 9,861,130 B2
(45) Date of Patent: Jan. 9, 2018

(54) ATOMIZING ASSEMBLY, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Hongyong Luo, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 508 days.

(21) Appl. No.: 14/539,993

(22) Filed: Nov. 12, 2014

(65) Prior Publication Data

US 2015/0128977 A1 May 14, 2015

(30) Foreign Application Priority Data

Nov. 12, 2013 (CN) ..... 2013 1 0557421

(51) Int. Cl.
*A24F 47/00* (2006.01)
*H05B 3/06* (2006.01)

(52) U.S. Cl.
CPC ..... *A24F 47/008* (2013.01); *H05B 3/06* (2013.01)

(58) Field of Classification Search
CPC ..... A24F 47/008
See application file for complete search history.

(56) References Cited

U.S. PATENT DOCUMENTS

2012/0279512 A1* 11/2012 Hon ..... A24F 47/008 131/329

FOREIGN PATENT DOCUMENTS

EP 2614732 A1 * 7/2013 ..... A24F 47/008
WO WO 2013149484 A1 * 10/2013 ..... A24F 47/008

OTHER PUBLICATIONS

Ryan, V., "How to Use a Knurling Tool", 2003, Technology Student, accessed at technologystudent.com on Mar. 29, 2017.*

* cited by examiner

*Primary Examiner* — Alison L Hindenlang
*Assistant Examiner* — Jamel M Nelson
(74) *Attorney, Agent, or Firm* — Cheng-Ju Chiang

(57) ABSTRACT

An exemplary atomizing assembly includes a heating component, a holder, an electrode, and a cover. The heating component includes a liquid conducting element and a heating element in contact with the liquid conducting element. The holder includes two arms extending from a first end thereof. The two arms and the cover cooperatively define a receiving space. The heating component is received in the receiving space. The electrode is arranged in the holder and is insulated from the holder. Two ends of the heating element are connected with the holder and the electrode respectively. The holder further includes a connection part arranged at an opposite second end, and the connection part is configured for detachably engaging with an external component.

10 Claims, 7 Drawing Sheets

ATOMIZING ASSEMBLY, ATOMIZER AND ELECTRONIC CIGARETTE HAVING SAME

TECHNICAL FIELD

The present invention relates to electronic cigarettes, and particularly to an atomizing assembly, an atomizer, and an electronic cigarette using same.

BACKGROUND ART

An electronic cigarette includes an atomizer and a battery assembly. The atomizer includes an atomizing assembly having a heating component for heating tobacco solution. In a typical electronic cigarette, the atomizing assembly is generally fixed in the atomizer and is not detachable. When the heating component becomes aging, the performance of the electronic cigarette is unsatisfactory. In this case, the atomizer as a whole should be replaced. Therefore, the cost to use the electronic cigarette is high.

What is needed, therefore, is an atomizing assembly, an atomizer, and an electronic cigarette using same, which can overcome the above shortcomings.

SUMMARY

An exemplary atomizing assembly includes a heating component, a holder, an electrode, and a cover. The heating component includes a liquid conducting element and a heating element in contact with the liquid conducting element. The holder includes two arms extending from a first end thereof. The two arms and the cover cooperatively define a receiving space. The heating component is received in the receiving space. The electrode is arranged in the holder and is insulated from the holder. Two ends of the heating element are connected with the holder and the electrode respectively. The holder further includes a connection part arranged at an opposite second end, and the connection part is configured for detachably engaging with an external component.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below and with references to the drawings.

Figure 1:
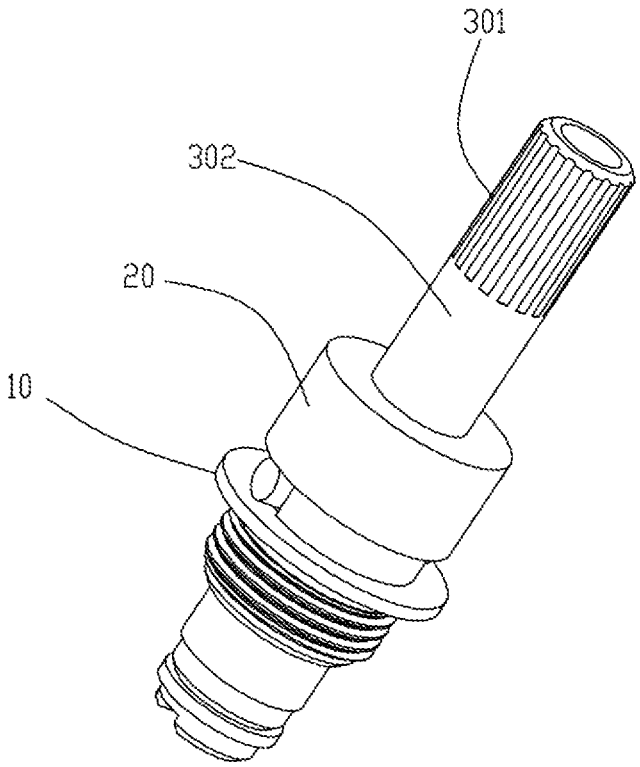
FIG. 1 is a perspective view of an atomizing assembly according to a first embodiment.
Figure 2:
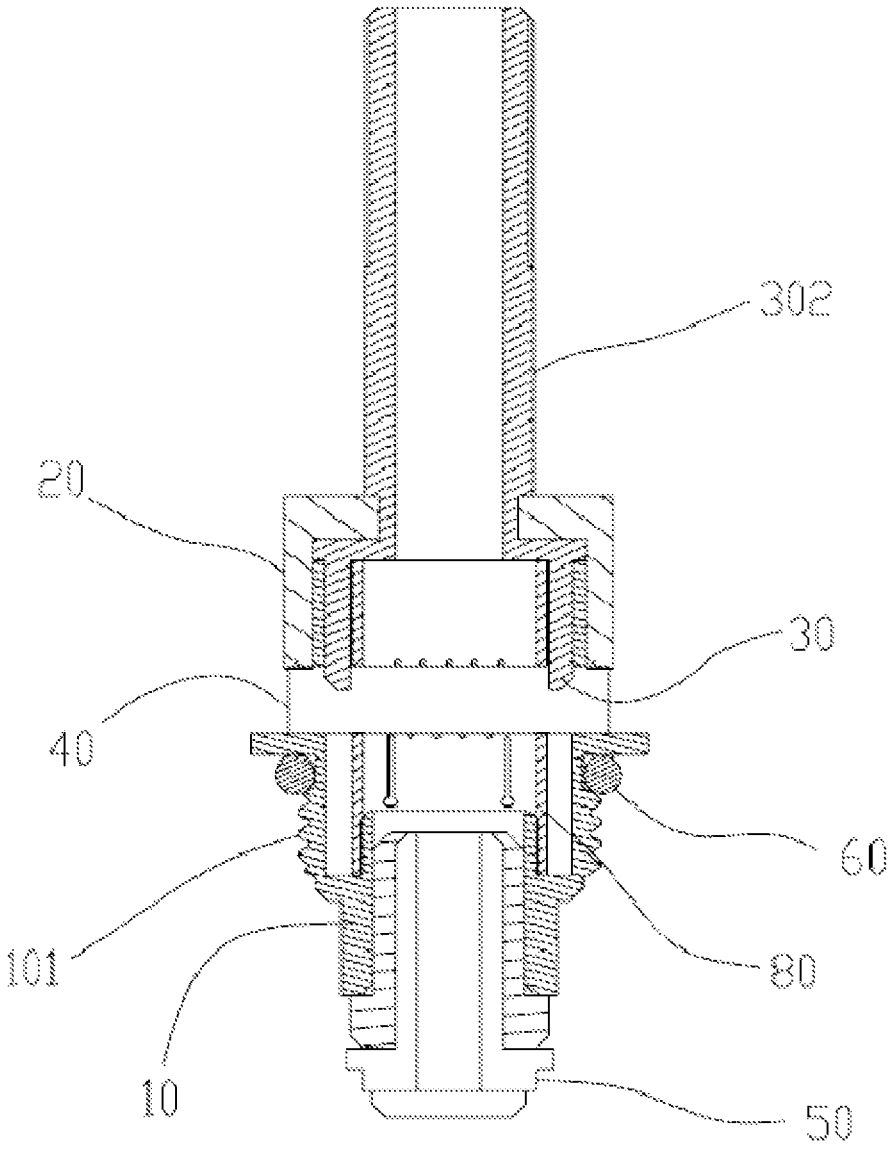
FIG. 2 is a cross-sectional view of the atomizing assembly of FIG. 1.
Figure 3:
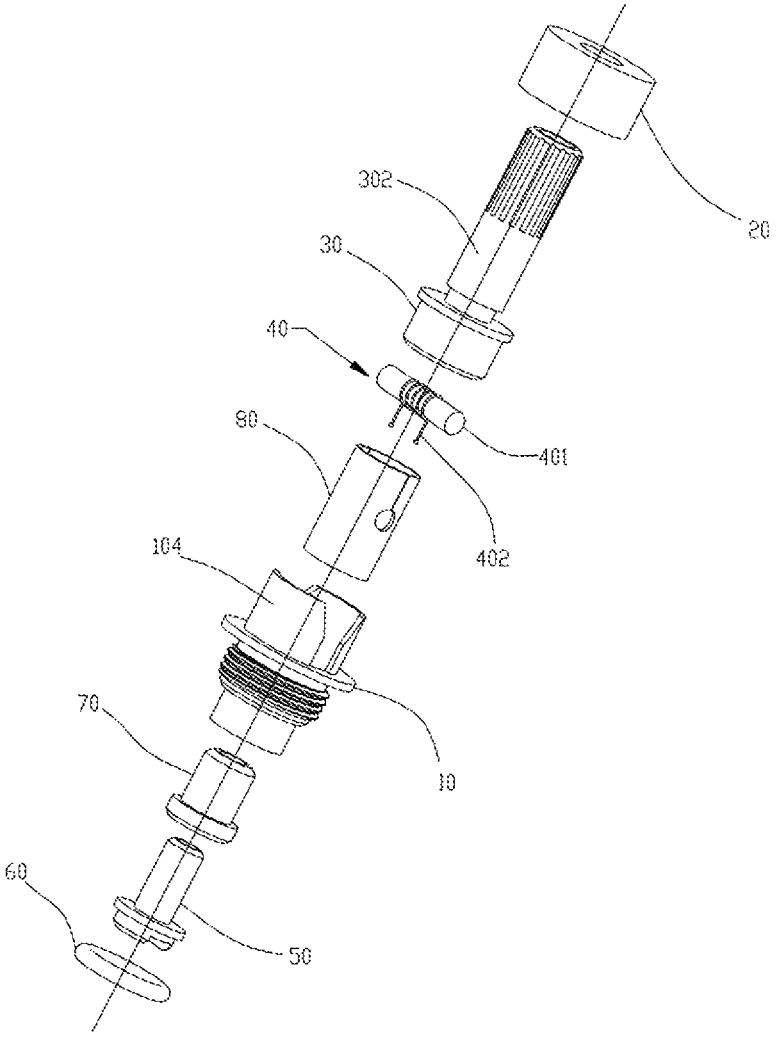
FIG. 3 is an exploded perspective view of the atomizing assembly of FIG. 1.
Figure 5:
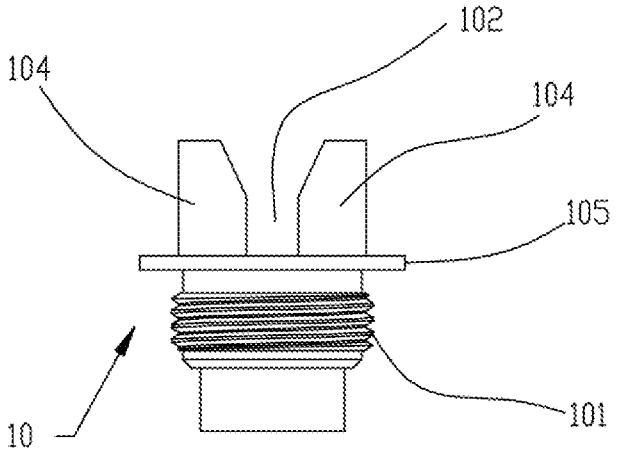
FIG. 5 is a side view of a holder of the atomizing assembly of FIG. 1.

Referring to FIGS. 1-2, an atomizing assembly for an electronic cigarette includes a heating component 40, a holder 10, a tubular electrode 50, and a cover 30. Referring to FIG. 3, the heating component 40 includes a liquid conducting element 401 and a heating element 402 wound around the liquid conducting element 401. Referring to FIG. 5, one end of the holder 10 extends outwards to form two separate arms 104, and the two arms 104 cooperatively form a receiving space 102. The liquid conducting element 401 is received in the receiving space 102. One end of the cover 30 is connected with the two arms 104. The cover 30 is positioned above the liquid conducting element 401. In the present embodiment, the cover 30 is engaged in the two arms 104 by interference fit, the tubular electrode 50 is arranged in the holder 10, an insulated ring 70 is sandwiched between the tubular electrode 50 and the holder 10, and two opposite ends of the heating element 402 are respectively connected with the holder 10 and the tubular electrode 50. The cover 30 extends to form a tube body 302, which communicates with the receiving space 102. In the present embodiment, the tube body 302 and the cover 30 are integrally formed, both of the tube body 302 and the cover 30 are a hollow cylinder, and an outer diameter of the cover 30 is larger than that of the tube body 302. The internal space of the cover 30 serves as an atomizing chamber, and the internal space of the tube body 302 serves as an air passage. A free end of the tube body 302 is configured (i.e., structured and arranged) for coupling with a mouthpiece.

In other embodiments, the heating element 402 are not wound around the liquid conducting element 401, and may instead be in contact with an outer surface of the liquid conducting element 401 in other way. In other embodiments, the cover 30 is not engaged in the two arms 104, instead, the two arms 104 are nested in the cover 30.

Figure 4:
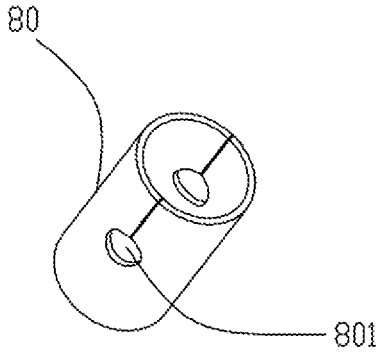
FIG. 4 is a perspective view of an insulated tube of the atomizing assembly of FIG. 1.
Figure 6:
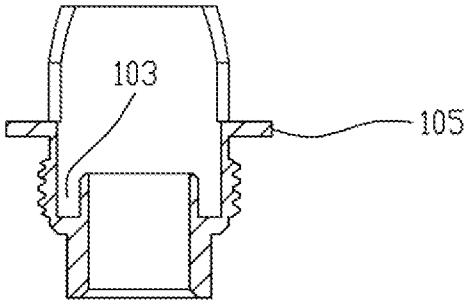
FIG. 6 is a cross-sectional view of the holder of FIG. 1.

Referring to FIGS. 2-4, the atomizing assembly further includes an insulated tube 80 arranged in the holder 10. The insulated tube 80 defines two through holes 801 in a sidewall. Two ends of the liquid conducting element 401 extends through the two through holes 801 and exposes from the two arms 104, and the heating element 402 is positioned in the insulated tube 80. In the present embodiment, the liquid conducting element 401 is engaged in the through holes 801 by interference fit. Due to the interference fit, risk of liquid leakage of the liquid conducting element 401 is greatly reduced when the atomizing assembly is vibrated. Referring to FIG. 6 again, the holder 10 defines an annular groove 103, and one end of the insulated tube 80 is engaged in the annular groove 103. The insulated tube 80 prevents two lead feet of the heating element 402 from contacting with the holder 10 simultaneously, thus avoiding short circuit. Since the heating element 402 is located in the insulated tube 80, the insulated tube 80 prevents heat from radiating from the holder 10.

Referring to FIG. 5, the holder 10 includes a flange 105 protruding from an outer surface. The flange 105 divides the holder 10 into two parts (i.e., the two arms 104 and a connection part 101). The connection part 101 includes a plurality of screws.

Referring to FIG. 2, the atomizing assembly further includes a seal ring 60 nesting the connection part 101. The connection part 101 is located between the screws and the flange 105.

Referring to FIG. 3, the tube body 302 includes knurling 301 at one end away from the cover 30. The knurling 301 is configured for facilitating the assembly and disassembly of the atomizing assembly.

Referring to FIG. 2, the atomizing assembly further includes a seal sleeve 20 wrapped around the two arms 104. The cover 30 is pressed against an outer surface of the liquid conducting element 401.

In the present embodiment, the insulated tube 80 is a glass fiber tube, and the liquid conducting element 401 is a glass fiber core.

Figure 7:
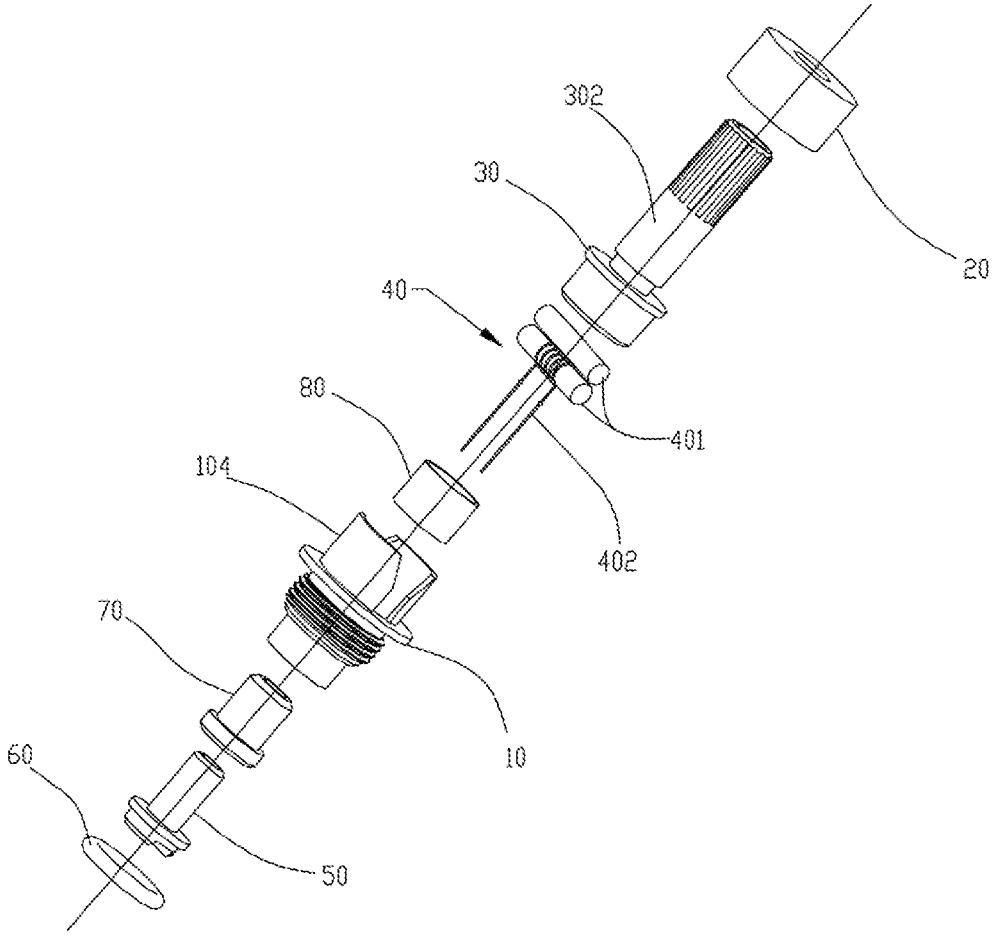
FIG. 7 is an exploded perspective view of an atomizing assembly according to a second embodiment.

Referring to FIG. 7, an atomizing assembly in accordance with a second embodiment is shown. The second embodiment mainly differentiates the first embodiment in that the second embodiment includes two liquid conducting elements 401, and the heating element 402 is wound around one of the two liquid conducting elements 401. The two liquid conducting elements 401 are oriented along an identical direction, and in tight contact with each other in side surface. The two liquid conducting elements 401 can store more tobacco solution than only one liquid conducting element, and thus, the atomizing assembly can generate more aerosols on condition that heat generated by the heating element 402 is fixed.

Only two lead feet of the heating element 402 are positioned within the insulated tube 80. No through hole is defined in a sidewall of the insulated tube 80, and the liquid conducting element 401 is positioned above the insulated tube 80.

Figure 8:
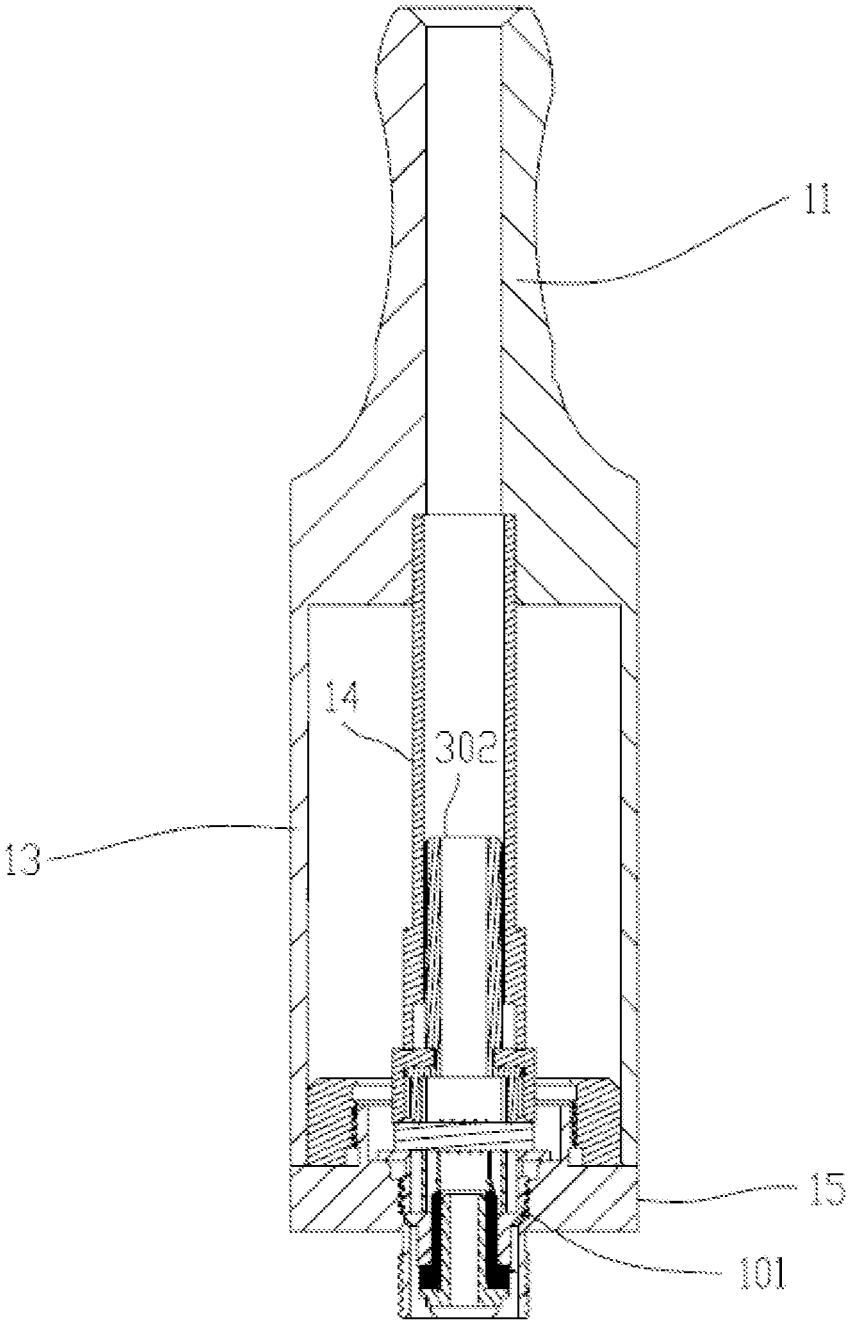
FIG. 8 is a cross-sectional view of an atomizer according to a third embodiment.

Referring to FIG. 8, an atomizer for an electronic cigarette is shown. The atomizer includes an atomizing sleeve 13, a mouthpiece 11, an air pipe 14 in the atomizing sleeve 13, a base 15, and the atomizing assembly of the first embodiment. The mouthpiece 11 and the base 15 are arranged at two opposite ends of the atomizing sleeve 13. The tube body 302 is received in the air pipe 14, and the connection part 101 is threadedly coupled with the base 15. The atomizing assembly as a whole is detachable. Accordingly, when the atomizing assembly is broken, the atomizing assembly may be replaced by a new atomizing assembly.

The liquid conducting element 401 is adapted for absorbing tobacco solution in the atomizing sleeve 13. The heating element 402 is configured for heating the tobacco solution in the liquid conducting element 401 to form aerosol. The aerosol passes through the tube body 302 and the air pipe 14, and then flows out from the mouthpiece 11.

Figure 9:
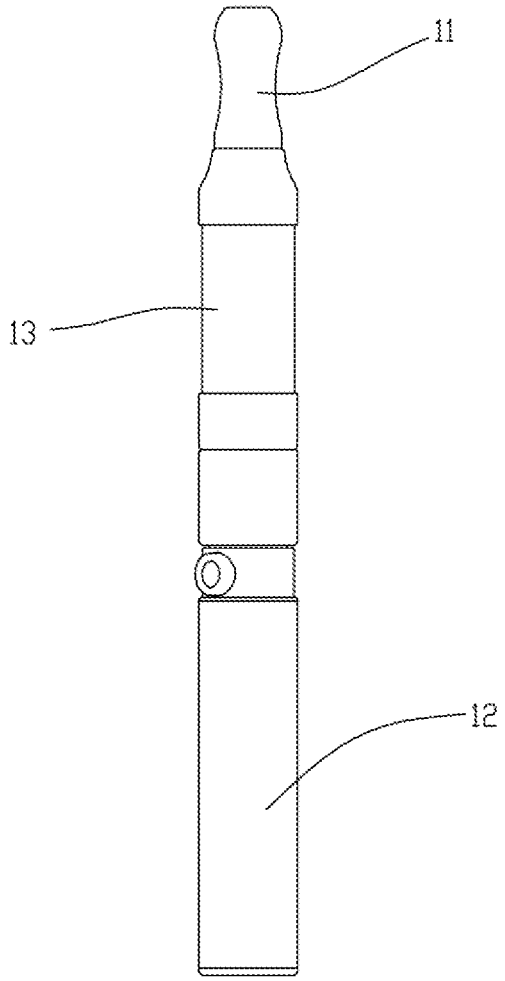
FIG. 9 is a side view of an electronic cigarette according to a fourth embodiment.

Referring to FIG. 9, an electronic cigarette is shown. The electronic cigarette includes a battery assembly 12 and an atomizer in accordance with the third embodiment. The atomizer is threadedly coupled at one end of the battery assembly 12.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizing assembly, comprising:

a heating component, the heating component comprising a liquid conducting element and a heating element in contact with the liquid conducting element;

a holder, the holder comprising two arms extending from a first end thereof;

an electrode; and a cover extending to be positioned between the two arms of the holder and to be engaged between the two arms of the holder by interference fit;

wherein the two arms and the cover cooperatively defining a receiving space, the heating component being received in the receiving space, the electrode is arranged in the holder and is insulated from the holder, two ends of the heating element are connected with the holder and the electrode respectively, the holder comprises a connection part arranged at an opposite second end, and the connection part is configured for detachably engaging with an external component.

2. The atomizing assembly according to claim 1, further comprising an insulated tube, wherein the heating element comprises two lead feet at two opposite ends thereof, and the two lead feet are both positioned in the insulated tube.

3. The atomizing assembly according to claim 2, wherein the insulated tube comprises a sidewall defining two through holes, and the liquid conducting element extends through the two through holes, and exposes from the two arms.

4. The atomizing assembly according to claim 1, wherein the cover extends to form a tube body, which communicates with the receiving space.

5. The atomizing assembly according to claim 4, wherein the tube body comprises knurling at one end away from the cover.

6. The atomizing assembly according to claim 1, wherein the connection part comprises a plurality of screws.

7. The atomizing assembly according to claim 1, wherein the holder further comprises a flange between the two arms and the connection part, the atomizing assembly further comprises a seal ring between the flange and the connection part.

8. The atomizing assembly of claim 1, further comprising a seal sleeve wrapping around the two arms.

9. The atomizing assembly according to claim 1, wherein the heating component comprises two liquid conducting elements oriented in an identical direction, two liquid conducting elements are in contact with each other in side surface, and the heating element is wound around one of the two liquid conducting elements.

10. An atomizer for an electronic cigarette, comprising:

an atomizing sleeve;

a mouthpiece;

a base; and an atomizing assembly, comprising:

a heating component, the heating component comprising a liquid conducting element and a heating element in contact with the liquid conducting element;

a holder, the holder comprising two arms extending from a first end thereof;

an insulated tube disposed inside the holder;

an electrode disposed inside the insulated tube to be insulated from the holder; and a cover;

wherein the two arms and the cover cooperatively defining a receiving space, the heating component being received in the receiving space, the electrode is arranged in the holder and is insulated from the holder, two ends of the heating element are connected with the holder and the electrode respectively, the holder comprises a connection part arranged at an opposite second end and an annular groove is defined inside the connection part of the holder for one end of the insulated tube being fixedly engaged in the annular groove, and the connection part is configured for detachably engaging with an external component, the mouthpiece and the base are arranged at two opposite ends of the atomizing sleeve, the connection part of the holder is detachably connected with the base.

* * * * *